United States Patent [19]

Finnenthal et al.

[11] Patent Number: 5,026,440

[45] Date of Patent: Jun. 25, 1991

[54] CHROMIUM FREE TREATMENT BEFORE COATING METAL SURFACES

[75] Inventors: Cornelia Finnenthal, Bergheim-Fliesteden; Wolf-Achim Roland, Solingen; Roland Morlock, Bergheim, all of Fed. Rep. of Germany

[73] Assignee: Gerhard Collardin GmbH, Koeln-Ehrenfeld, Fed. Rep. of Germany

[21] Appl. No.: 398,108

[22] Filed: Aug. 24, 1989

[30] Foreign Application Priority Data

Aug. 27, 1988 [DE] Fed. Rep. of Germany ..... 3829154

[51] Int. Cl.[5] ..... C23C 22/48; C23C 22/75

[52] U.S. Cl. ..... 148/247; 148/256

[58] Field of Search ..... 148/247, 256

[56] References Cited

U.S. PATENT DOCUMENTS 3,850,732 11/1974 Benns ..... 148/247
3,912,548 10/1975 Faigen ..... 148/247
4,496,404 1/1985 King ..... 148/6.14 R
4,539,048 9/1985 Cohen ..... 106/287.17
4,539,049 9/1985 Cohen ..... 106/287.17
4,650,526 3/1987 Claffey et al. ..... 148/6.14 R

FOREIGN PATENT DOCUMENTS 2704260 8/1979 Fed. Rep. of Germany ..... 148/247

*Primary Examiner*—Sam Silverberg
*Attorney, Agent, or Firm*—Ernest G. Szoke; Wayne C. Jaeschke; Norvell E. Wisdom, Jr.

[57] ABSTRACT

The adhesion of, and corrosion protection provided by, organic surface coatings to underlying metal can be significantly improved if the degreased, etched, and pickled metal surfaces to be coated are first treated with an aqueous solution and/or dispersion of aluminum-zirconium complexes, which are obtainable as the reaction-product of a chelated aluminum component, an organo-functional ligand component, and a zirconium oxyhalide component, with the organo-functional ligand being chemically bonded to the chelated aluminum unit and the zirconium unit in the complex, and are subsequently treated with dilute aqueous solutions, emulsions, and/or dispersions of one or more inorganic and/or organic film-forming materials prior to coating the surfaces with conventional organic surface coatings.

20 Claims, No Drawings

CHROMIUM FREE TREATMENT BEFORE COATING METAL SURFACES

FIELD OF THE INVENTION

This invention relates to an improved process for treating metallic surfaces to increase the quality of subsequently applied organic surface coatings.

STATEMENT OF RELATED ART

The use of chromates or chromic acid in aqueous solution for producing conversion layers on surfaces of aluminum, aluminum alloys, zinc, cadmium, magnesium, steel and/or galvanized or alloy zinc-plated steel has long been known. These conversion layers substantially improve the adhesion and the corrosion-inhibiting effect of subsequent coatings with organic materials such as, for example, paints, powder coats, or films.

Conversion layers are also employed, particularly on aluminum, its alloys, and zinc as anticorrosive coatings without any subsequent top coating over them. Another area of application of chromates and chromic acid is the operation of after-rinsing zinc phosphate and iron phosphate conversion layers on steel and zinc-plated steel. Such after-treatment also results in a distinct improvement of the adhesion of subsequent coatings of organic materials and an increase in the corrosion resistance of the coated metallic surfaces.

In the pre-treatment of aluminum prior to coating it with organic materials, the conventional course of operations is as follows:

1. Cleaning (degreasing) in relatively mild alkaline aqueous solutions.
2. Rinsing in fresh water.
3. Etching in highly alkaline solutions.
4. Rinsing in fresh water.
5. Pickling in acidic solutions.
6. Rinsing in fresh water.
7. Chromating with solutions containing chromate and/or chromic acid.
8. Rinsing in fresh water.
9. Rinsing in fully deionized water.
10. Drying the conversion coatings.

Because of the toxic properties of chromium (VI) compounds, the waste liquids from the operation and disposal of the baths must be subjected to an especially expensive treatment. Such treatment is also required for the waste water from the aforementioned rinses, becasue these effluents also contain chromium (VI) compounds. The particularly critical toxic properties of chromates and chromium oxides in the form of breathable dusts and aerosols require strict precautions in the preparation and use of the pre-treatment chemicals for protecting the workers during these processes.

For the reasons set forth above, many attempts were made in the past to substitute other less toxic or nontoxic compounds for the chromium (VI) compounds in thepre-treatment of metals prior to coating them with organic materials.

For the pre-treatment of aluminum, for example, processes utilizing chromium (III) compounds or utilizing compounds of zirconium and/or titanium have been known and in part adopted for commercial use. In the literature the corrosion-inhibiting activity of molybdates and tungstates has also been reported. However, there are no commercial processes known that use molybdates or tungstates.

The above-mentioned processes based on the use of chromium (III) compounds and on the use of zirconium and/or titanium compounds either have been accepted and established only in special fields or are not comparable, with respect to the quality attained and to the breadth of possible applications, with processes based on the use of chromium (VI) compounds. The same is applicable to the field of after treatments for zinc and iron phosphate conversion layers.

However, due to new developments a class of substances has gained interest for a use in aqueous solutions for pre-treating metals prior to coating them with organic materials, which class of substances comprises organometallic compounds. In the past it was impossible to employ organometallic compounds in an aqueous solution because virtually all known representatives of this class of substances were more or less subject to hydrolysis.

In U.S. Pat. No. 4,650,526 of Mar. 17, 1987 to Claffey et al. there is described a process for treating phosphated metal surfaces prior to coating them with organic materials. More particularly, the use of certain organometal compounds in solutions used especially for post-treatment after phosphating, for improving the adhesion of subsequently applied organic coatings, is decribed. These organometallic compounds are aluminum-zirconium complexes, many of which are sold by the Cavedon Chemical Co. under the designation of "CAVCOMOD". The preparation of the aluminum-zirconium complexes is described in the U.S. Pat. Nos. 4,539,048 and 4,539,049, both of Sept. 3, 1985 to Cohen.

It is one object of the present invention to improve the process for pre-treating metallic surfaces before coating them with organic materials. It is another object of the present invention to attain acceptable values of adhesion and protection from corrosion of surfaces after they are coated with organic materials. In the attainment of both these objects, the use of chromium is to be avoided.

DESCRIPTION OF THE INVENTION

In this description, except in the operating examples and where expressly stated to the contrary, all numbers specifying amounts of materials or conditions of reaction or use are to be understood as modified by the term "about".

The objects of the invention are attained by the application of a combination of the aluminum-zirconium complexes described in U.S. Pat. No. 4,650,526 with an organic and/or inorganic film-forming material. Conversion layers may be produced, particularly on aluminum and its alloys, which layers exhibit very good adhesion properties and improved anticorrosive properties for subsequent organic coatings.

Thus, one embodiment of the invention is a process for the pre-treatment of metallic surfaces in which cleaned (degreased), etched, and pickled surfaces are contacted with an aqueous solution and/or dispersion of aluminum-zirconium complexes which are obtainable as the product of reaction of a chelated aluminum component, an organo-functional ligand component, and a zirconium oxyhalide component, the organo-functional ligand being chemically bonded in the product of reaction to both the chelated aluminum unit and the zirconium unit, and the surfaces are subjected to a subsequent treatment with aqueous solutions, emulsions, and/or dispersions of one or more inorganic and/or organic film-forming materials (alternatively called film formers) prior to coating the surfaces with organic materials to form an outer coating thereon. The aqueous solutions, emulsions, and/or dispersions of inorganic and/or organic film formers used in this invention are distinguished from conventional paints or other protective surface coatings, and also from conventional primers for such surface coatings by a solids content of not more than 2 grams/liter ("g/l"). As a result of this low solids content, the mass added to the objects by this treatment is not more than 0.5 grams per square meter of surface treated ("$g/m^2$") and the average thickness of the films formed by this treatment is not more than 0.5 microns ("$\mu m$").

In the course of the investigations it was found that a treatment of aluminum with only the above identified aluminum-zirconium complexes as described in the U.S. Pat. No. 4,650,526, in the absence of an additional organic and/or inorganic film- forming material, often results in an improvement of the adhesion and the corrosion resistance of an organic coating subsequently applied, compared with a substrate that is untreated except for simple cleaning. However, values of adhesion and corrosion resistance as good as those achieved with a pretreatment based on chromium (VI) compounds can not be achieved by such treatment of aluminum with only the aluminum-zirconium complexes, but can be achieved by a combination of treatment with such complexes and subsequent treatment with organic and/or inorganic film-forming materials, as taught herein.

In a preferred embodiment of the present invention, metallic surfaces of aluminum, aluminum alloys, zinc, cadmium, magnesium, steel, galvanized steel, and/or zinc alloy plated steel are the substrates to be coated.

The above-identified aluminum-zirconium complexes as described in the U.S. Pat. No. 4,650,526 can be brought into contact with the surfaces by spraying, immersing, flooding, roller-coating, rolling, or any other convenient method. These aluminum-zirconium complexes are obtainable by reacting together a chelated aluminum compound component, an organo-functional ligand component, and a zirconium oxyhalide component, wherein:

(1) the chelated aluminum compound component is selected from compounds represented by the general formula (I)

$$Al_2(OR^1O)_aA_bB_c \quad (I)$$

wherein each of A and B independently represents a hydroxyl, fluoro, chloro, bromo or iodo group, preferably a chloro or hydroxyl group; each of a, b, and c denotes a number and $2a+b+c=6$; preferably a is between 0.05 and 2, more preferably between 0.1 and 1, b is between 0.05 and 5, more preferably between 1 and 5, and c is between 0.05 and 5, more preferably between 1 and 5; most preferably, A is hydroxy, b is between 2 and 5, B is chloro, and c is between 1 and 3.8; and $(OR^1O)$ represents:

(A) a moiety derived from a $\alpha\beta$- or $\alpha,\gamma$- diol having from 2 to 6, preferably from 2 to 3, carbon atoms by removing the hydrogen atoms from both hydroxyl groups in the diol, with $R^1$ representing a moiety with a formula derived from the formula of an alkane, alkene, or alkyne, preferably an alkane, by removing one hydrogen atom from each of two distinct carbon atoms therein; or (B) a moiety having a chemical formula derived by removing a hydrogen atom from each of the carboxyl and hydroxy groups of an $\alpha$-hydroxycarboxylic acid having a total of 2 to 6, preferably 2 to 3, carbon atoms;

(2) the organo-functional ligand component is selected from alkyl-, alkenyl-, alkynyl-, or aralkyl-carboxylic acid, having from 2 to 36, preferably from 4 to 18, carbon atoms and preferably having no atoms other than carbon, hydrogen, and oxygen; amino-functional carboxylic acids having from 2 to 18, preferably from 4 to 18 carbon atoms, preferably with no atoms other than carbon, hydrogen, oxygen, and nitrogen and no nitrogen functional group other than amino; dibasic carboxylic acids having from 2 to 18, preferably 2 to 6, carbon atoms, preferably having the carboxyl groups in the terminal positions, and preferably with no atoms other than carbon, hydrogen, and oxygen; anhydrides of a dibasic carboxylic acid having from 2 to 18, preferably 2 to 6, carbon atoms, preferably with no atoms other than carbon, hydrogen, and oxygen; mercapto-functional carboxylic acids having from 2 to 18, preferably 2 to 6, carbon atoms, preferably with no atoms other than carbon, hydrogen, oxygen, and sulfur and no sulfur functional group other than mercapto; and epoxy-functional carboxylic acids having from 2 to 18, preferably 2 to 6, carbon atoms, preferably with no atoms other than carbon, hydrogen, and oxygen and no oxygen containing fucntional groups other than carboxyl and epoxide;

(3) the zirconium oxyhalide component has atomic proportions corresponding to the formula $Zr(OH)_dG_e$, wherein G represents the sum of fluorine, chlorine, bromine, and iodine, each of d and e is a number between 0.05 and 3.95, and $d+e=4$; preferably each of d and e is at least 1; and (4) the molar ratio of the chelated aluminum compound to the zirconium oxyhalide is from 1.5 to 10, and the molar ratio of the organo-functional ligand to the total metal content is from 0.05 to 3.

Examples of suitable reactants in each of the three types and methods for preparation of the complexes are given in column 6 line 4 to column 7 line 26 of U.S. Pat. No. 4,650,526, the entire specification of which, to the extent not inconsistent with any express statement herein, is hereby incorporated herein by reference.

In a preferred embodiment of the present invention the above-mentioned aluminum-zirconium complexes are employed at a concentration of from 0.05 to 50 g/l in an aqueous solution and/or dispersion. According to another embodiment of the present invention, the period of contact is from 1 second to 5 minutes at a bath temperature of 10°-60° C.

Preferred organic film-forming materials employed within the scope of the present invention are aqueous solutions, emulsions and/or dispersions of polyacrylic acid, polyacrylates, polyesters, polyurethanes, and/or polyepoxy compounds at a concentration of from 0.01 to 2 g/l of bath.

The treating liquid containing the organic film formers can be brought into contact with the surfaces by spraying, immersing, flooding, roller-coating, rolling, and any other convenient method. According to one embodiment of the invention the contact time of the aqueous solutions, emulsions and/or dispersions containing the organic film formers is from 1 second to 5 minutes at a bath temperature of from 10° to 60° C.

Preferred inorganic film formers employed within the scope of the present invention are aqueous solutions and/or dispersions of metal oxides at a concentration of from 0.05 to 5 g/l of liquid. Particularly preferred within the scope of the present invention are metal oxides selected from the group consisting of silicon oxide, titanium dioxide and/or aluminum oxide.

The inorganic film formers, in the form of aqueous solutions or dispersions, are brought into contact with the metal surfaces to be coated over a period of from 1 second to 5 minutes at a bath temperature of from 10° C. to 60° C. in the same manner as the organic film formers.

In a further preferred embodiment of the present invention free or complex fluorides in a concentration of from 0.01 to 1 g/l are added to the aqueous solutions containing the aluminium-zirconium complexes.

The general formula (IV) of the aluminium-zirconium complexes may be represented as follows:

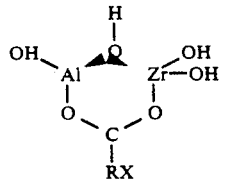

wherein R represents a divalent hydrocarbon moiety and X represents a functional group.

The exact product designations of the commercially available solutions of the aluminum-zirconium complexes depend on the functionality and on the solvent used in the commercial products. The commercial products noted below are set forth in U.S. Pat. No. 4,650,526, column 9 lines 36–62.

The invention is further illustrated by the following non-limiting operating examples.

EXAMPLES

Comparative Example 1

Aluminum sheets (Al 99.5) having the dimensions of 100 mm×200 mm×0.7 mm were treated as follows:

1) Immersion in a conventional alkaline cleanser (RIDOLINE C 1515, available from Gerhard Collardin GmBH, Cologne, West Germany, containing sodium hydroxide, phosphates, complexing agents and nonionic surfactants).
   Concentration: 3% (by weight) in fresh water;
   Time: 3 minutes;
   Temperature: 60° C.
2) Immersion-rinsing in fresh water.
   Time: 1 minute;
   Temperature: RT (room temperature).
3) Removing the oxide surface layer by immersion in a chromium-free agent (DEOXIDIZER 395 H, containing complex fluorides in an acidic solution, available from Gerhard Collardin GmBH, Cologne, West Germany). Concentration: 2% (by vol.) in fresh water;
   Time 1 minute;
   Temperature: 40° C.
4) Immersion-rinsing in fresh water.
   Time: 1 minute;
   Temperature: RT.
5) Immersion in a solution containing aluminum-zirconium complexes (CAVCOMOD A).
   Concentration:
   a) 0.1% (by volume) of the commercial form
   b) 1% (by volume) of the commercial form;
   Time: 3 minutes;
   Temperature: RT.
6) Immersion-rinsing as in 2) and 4).
7) Immersion-rinsing in fully deionized water.
8) Drying with warm air.
   Time: 3 minutes;
   Air temperature: 70° C.

COMPARATIVE EXAMPLE 2.1

Treatment steps 1)–4) and 6)–8) were the same as in Comparative Example 1

5) Immersion in a "zircoaluminate solution", CAVCOMOD APG
   Concentration:
   a) 0.1% (by vol.) of the commercial form in fully deionized water
   b) 1.0% (by vol.) of the commercial form in fully deionized water;
   Time: 3 minutes;
   Temperature: RT.

COMPARATIVE EXAMPLE 2.2

Treatment steps 1)–4) and 6)–8) were the same as in Comparative Example 1

5) Immersion in a "zircoaluminate solution", CAVCOMOD C
   Concentration:
   a) 0.1% (by vol.) of the commercial form in fully deionized water
   b) 1.0% (by vol.) of the commercial form in fully deionized water;
   Time: 3 minutes;
   Temperature: RT.

COMPARATIVE EXAMPLE 2.3

Treatment steps 1)–4) and 6)–8) were the same as in Comparative Example 1.

5) Immersion in a "zircoaluminate solution", CAVCOMOD CPM.
   Concentration:
   a) 0.1% (by vol.) of the commercial form in fully deionized water
   b) 1.0% (by vol.) of the commercial form in fully deionized water;.
   Time: 3 minutes;
   Temperature: RT.

COMPARATIVE EXAMPLE 2.4

Treatment steps 1)–4) and 6)–8) were the same as in Comparative Example 1.

5) Immersion in a "zircoaluminate solution", CAVCOMOD C-1.
   Concentration:
   a) 0.1% (by vol.) of the commercial form in fully deionized water
   b) 1.0% (by vol.) of the commercial form in fully deionized water;
   Time: 3 minutes;
   Temperature: RT.

COMPARATIVE EXAMPLE 2.5

Treatment steps 1)–4) and 6)–8) were the same as in Comparative Example 1

5) Immersion in a "zircoaluminate solution", CAVCOMOD F. Concentration:

a) 0.1% (by vol.) of the commercial form in fully deionized water
b) 1.0% (by vol.) of the commercial form in fully deionized water.

COMPARATIVE EXAMPLE 2.6

Treatment steps 1)–4) and 6)–8) were the same as in Comparative Example 1.

5) Immersion in a "zircoaluminate solution", CAVCO-MOD M.
Concentration:
a) 0.1% (by vol.) of the commercial form in fully deionized water
b) 1.0% (by vol.) of the commercial form in fully deionized water.

COMPARATIVE EXAMPLE 2.7

Treatment steps 1)–4) and 6)–8) were the same as in Comparative Example 1.

5) Immersion in a "zircoaluminate solution", CAVCO-MOD M 1.
Concentration:
a) 0.1% (by vol.) of the commercial form in fully deionized water
b) 1.0% (by vol.) of the commercial form in fully deionized water;
Time: 3 minutes;
Temperature: RT.

The sheets according to Comparative Examples 1 and 2.1 to 2.7 were subsequently coated with a commercial polyester baking paint (Type GG 92 L from BASF Lacke und Farben AG). This paint has binder and pigment compositions designed for use on pre-treated aluminum objects intended to be exposed to outdoor weather conditions. Priming is not required. The paint was baked at an air temperature of 250° C. for 2 minutes and 15 seconds. The thickness of the dry paint layer was 25 to 30 μm. The sheets were then subjected to tests as shown below for adhesion and corrosion resistance.

Adhesion tests: Adhesion was measured with adhesive tape on a scale 0 to 5:
0=best result, no paint particles on the adhesive tape;
3=medium result, more than half of the paint on the adhesive tape;
5=poorest result, all of the paint on the adhesive tape.
Adhesion was measured in the vicinity of a cross-hatch according to DIN 53151 both before and after exposure to neutral salt spray according to DIN 50021 and on a T-Bend according to the European Coil-Coating Association (ECCA) Method T 7 only after exposure to salt spray. The latter test is done as follows:
The sheets are bent completely around a half-cylinder with a diameter equal to the sheet thickness, and the paint adhesion on the bend shoulder is evaluated by noting the amount of paint removable with adhesive tape as above.

Test for corrosion resistance: A scribe mark reaching down to the metal substrate through the paint is made, and after exposure to salt spray the width if any of the corroded zone in the vicinity of the scribe mark is determined.

The adhesion and corrosion data of the sheets according to Comparative Examples 1 and 2.1 to 2.7 are shown in Table 1.

EXAMPLES 1 AND 2.1–2.7

These examples were performed in the same manner as Comparative Examples 1 and 2.1–2.7 respectively, except that between steps 7) and 8) of Comparative Examples 1 and 2.1 - 2.7 there was an additional step 7I as follows:

7I) immersion in a solution in fully deionized water of Primal A 1, a polyacrylic acid commercially supplied by Rohm and Haas in the form of a 25% solution having a pH value of about 2; the molecular weight of the polyacrylic acid is about 60,000.
Concentration: 0.5 g/l
Time: 0. 5 minutes
Temperature: RT The sheets, after being allowed to drain but without having been rinsed after step 7I, were dried according to step 8) in Comparative Example 1. The sheets were painted as in Comparative Example 1 and subjected to the same adhesion and corrosion tests. The results are shown in Table 2.

TABLE 1

| Ex. No. | Adhesion after Salt Spray Exposure of: 0 G | 2,000 Hours T | 2,000 Hours G | Corrosion Around Scribe in mm After Exposure to Salt Spray for: 1000 Hours | 2000 Hours |
|---|---|---|---|---|---|
| 1a | 0 | 0 | 0 | 0 | 1.0 |
| b | 0 | 5 | 0 | 0.3 | 0.6 |
| 2.1a | 0 | 0 | 0 | 0 | 1.1 |
| b | 0 | 1–2 | 0 | 0.7 | 1.4 |
| 2.2a | 0 | 2–3 | 2 | 1.1 | 0.4 |
| b | 0 | 2–3 | 0 | 0 | 0 |
| 2.3a | 0 | 1 | 0 | 0 | 1.1 |
| b | 0 | 2 | 0 | 0.3 | 0.4 |
| 2.4a | 0 | 3 | 0 | 0.3 | 1.7 |
| b | 0 | 3–4 | 0 | 0.7 | 0.2 |
| 2.5a | 0 | 1 | 0 | 1.5 | 0.6 |
| b | 0 | 2–3 | 0 | 1.2 | 0.3 |
| 2.6a | 0 | 3–4 | 0 | 0.3 | 0.6 |
| b | 0 | 4–5 | 0 | 0 | 0.9 |
| 2.7a | 0 | 4 | 0 | 0 | 1.4 |
| b | 0 | 4 | 0 | 1.8 | 1.2 |

G = cross-hatch test; T = T-Bend test

EXAMPLES 2 AND 3.1–3.7

These examples were performed in the same manner as Examples 1 and 2.1–2.7 respectively, except that the concentration of the polyacrylic acid in step 7I was 1 g/l. The adhesion and anticorrosion data are shown in Table 3.

EXAMPLES 3 AND 4.1–4.7

These examples were performed in the same manner as Examples 1 and 2.1–2.7 respectively, except that in step 7I an aqueous silicon dioxide dispersion was used instead of a polyacrylic acid. Specifically, Syton TM X 30 from Monsanto/Brentag, a commercial dispersion having a solids content of 30%, a pH of 9.9, and silicon dioxide particles with an average specific surface area of about 250 square meters per gram ($m^2/g$), was used. The concentration of silicon dioxide in the immersion-rinsing bath used in step 7I for these examples was 3 g/l, the immersion time was 0.5 minute, and the temperature was ambient. The adhesion and corrosion resistance data found are also shown in Table 3.

TABLE 2

| Ex. No. | Adhesion after Salt Spray Exposure of: 0 G | 2,000 Hours T | 2,000 Hours G | Corrosion Around Scribe in mm After Exposure to Salt Spray for: 1000 Hours | 2000 Hours |
|---|---|---|---|---|---|
| 1a | 0 | 0 | 0 | 0 | 0.3 |
| b | 0 | 0 | 0 | 0 | 0 |
| 2.1a | 0 | 0 | 0 | 0 | 1.6 |

TABLE 2-continued

| Ex. No. | Adhesion after Salt Spray Exposure of: 0 G | 2,000 Hours T | 2,000 Hours G | Corrosion Around Scribe in mm After Exposure to Salt Spray for: 1000 Hours | 2000 Hours |
|---|---|---|---|---|---|
| b | 0 | 0 | 0 | 0 | 0 |
| 2.2a | 0 | 0 | 0 | 1.2/0* | 1.2/0.7* |
| b | 0 | 0 | 0 | 0 | 1.0 |
| 2.3a | 0 | 0 | 0 | 1.0 | 0.4 |
| b | 0 | 0 | 0 | 0 | 0 |
| 2.4a | 0 | 0 | 0 | 0 | 0.3 |
| b | 0 | 0 | 0 | 0 | 0 |
| 2.5a | 0 | 0 | 0 | 1.2/0* | 1.4 |
| b | 0 | 0 | 0 | 0 | 0.9 |
| 2.6a | 0 | 0 | 0 | 0 | 0.3 |
| b | 0 | 0 | 0 | 0 | 0 |
| 2.7a | 0 | 0 | 0 | 0 | 0.2 |
| b | 0 | 0 | 0 | 0 | 1.8 |

G = cross-hatch test; T = T-Bend test; * = Duplicate determinations.

TABLE 3

| Ex. No. | Adhesion after Salt Spray Exposure of: 0 G | 2,000 Hours T | 2,000 Hours G | Corrosion Around Scribe in mm After Exposure to Salt Spray for: 1000 Hours | 2000 Hours |
|---|---|---|---|---|---|
| 2a | 0 | 0 | 0 | 0 | 0.2 |
| b | 0 | 0 | 0-1 | 0 | 0 |
| 3.1a | 0 | 0 | 0 | 0.2 | 0.9/1.2* |
| b | 0 | 0 | 0 | 0 | 0 |
| 3.2a | 0 | 0 | 0 | 0 | 0.1 |
| b | 0 | 0 | 1 | 0 | 0 |
| 3.3a | 0 | 0 | 0 | 1.0/0.8* | 0.5 |
| b | 0 | 0 | 0 | 0 | 0 |
| 3.4a | 0 | 0 | 0 | 0 | 0.4 |
| b | 0 | 0 | 0 | 0.2 | 0 |
| 3.5a | 0 | 0 | 0 | 0 | 1.2/1* |
| b | 0 | 0 | 0-1 | 0 | 0.8 |
| 3.6a | 0 | 0 | 0 | 0 | 0.5 |
| b | 0 | 0 | 0 | 0.1 | 0 |
| 3.7a | 0 | 0 | 0 | 0 | 0.3 |
| b | 0 | 0 | 0 | 0 | 1.0 |
| 3a | 0 | 0 | 0 | 0 | 0 |
| b | 0 | 1-2 | 0 | 0 | 0 |
| 4.1a | 0 | 0 | 0 | 0 | 1.0 |
| b | 0 | 0 | 0 | 0 | 0 |
| 4.2a | 0 | 0 | 0 | 0 | 0 |
| b | 0 | 1 | 0 | 0 | 0.2 |
| 4.3a | 0 | 0 | 0 | 0 | 0 |
| b | 0 | 0 | 0 | 0 | 0.1 |
| 4.4a | 0 | 3 | 0 | 0 | 0 |
| b | 0 | 0 | 0 | 0 | 0 |
| 4.5a | 0 | 0-1 | 0 | 0 | 0.8 |
| b | 0 | 1 | 0 | 0 | 0.3 |
| 4.6a | 0 | 2 | 0 | 0 | 0.6 |
| b | 0 | 1 | 0 | 0 | 0 |
| 4.7a | 0 | 1 | 0 | 0 | 0.8 |
| b | 0 | 1 | 0 | 0 | 0 |

G = cross-hatch test; T = T-Bend test; * = Duplicate determinations

EXAMPLES 4 AND 5.1-5.7

The examples were performed in the same manner as Examples 3 and 4.1-4.7 respectively, except that the silicon dioxide concentration in the immersion-rinsing bath in step 7I was 1.5 g/l. The adhesion and corrosion resistance data found are shown in Table 4.

EXAMPLES 5 AND 6.1-6.7

These examples were performed in the same manner as Examples 1 and 2.1-2.7 respectively, except that the immersion bath in step 7I contained 3.0 g/l of the silicon dioxide dispersion used in Example 3 in addition to the 0.5 g/l of polyacrylic acid used in Example 1. The resulting adhesion and corrosion resistance data are also shown in Table 4.

EXAMPLES 6 AND 7.1-7.7

These examples were performed in the same manner as Example 5 and 6.1-6.7 respectively, except that (i) the various CAVCOMOD solutions used in step 5) each contained 0.5 g/l of hydrofluoric acid in addition to the zircoaluminate complex and (ii) the immersion time was only 8 seconds. The adhesion and corrosion resistance data found are shown in Table 5.

EXAMPLES 7 AND 8.1-8.7

These experiments were performed in the same manner as Experiments 1 and 2.1 to 2.7 respectively, except that in step 7I a polyacrylate was used instead of polyacrylic acid, and the concentration was different. Specifically, the commercially available Plextol TM DV 588 from Roehm GmbH was used. Its base monomers are butyl acrylate and methyl methacrylate; the commercial form of the dispersion has a solids content of 50%, the pH is 2.2±0.5, and the average particle diameter is 0.15 μm. The concentration of polyacrylate was used in step 7I for these examples was 0.5 g/l. The adhesion and corrosion resistance data resulting are also shown in Table 5.

TABLE 4

| Ex. No. | Adhesion after Salt Spray Exposure of: 0 G | 2,000 Hours T | 2,000 Hours G | Corrosion Around Scribe in mm After Exposure to Salt Spray for: 1000 Hours | 2000 Hours |
|---|---|---|---|---|---|
| 4a | 0 | 1 | 0 | 0.2 | 0.2 |
| b | 0 | 1 | 0 | 0 | 0.1 |
| 5.1a | 0 | 0 | 0 | 0.1 | 1.3 |
| b | 0 | 0 | 0 | 0 | 0 |
| 5.2a | 0 | 0 | 0 | 0 | 0.1 |
| b | 0 | 1 | 0 | 0 | 0.3 |
| 5.3a | 0 | 1 | 0 | 0.2 | 0.2 |
| b | 0 | 0 | 0 | 0 | 0.2 |
| 5.4a | 0 | 2 | 0 | 0 | 0.1 |
| b | 0 | 0 | 0 | 0 | 0.1 |
| 5.5a | 0 | 1 | 0 | 0.1 | 0.9 |
| b | 0 | 1 | 0 | 0 | 0.2 |
| 5.6a | 0 | 1 | 0 | 0 | 0.8 |
| b | 0 | 2 | 0 | 0 | 0 |
| 5.7a | 0 | 0 | 0 | 0.1 | 0.9 |
| b | 0 | 1 | 0 | 0 | 0.2 |
| 5a | 0 | 0 | 0 | 0 | 0 |
| b | 0 | 2-3 | 0 | 0 | 0 |
| 6.1a | 0 | 3 | 0 | 0 | 1.3 |
| b | 0 | 1-2 | 0 | 0 | 0 |
| 6.2a | 0 | 1 | 0 | 0 | 0.2 |
| b | 0 | 0 | 0 | 0 | 0.8 |
| 6.3a | 0 | 0 | 0 | 0 | 1.2 |
| b | 0 | 0 | 0 | 0 | 0 |
| 6.4a | 0 | 1 | 0 | 0 | 0.8 |
| b | 0 | 0 | 0 | 1.6 | 1.0 |
| 6.5a | 0 | 1 | 0 | 0 | 0 |
| b | 0 | 3 | 0 | 0 | 0 |
| 6.6a | 0 | 0 | 0 | 0 | 0.9 |
| b | 0 | 0 | 0 | 0 | 0 |
| 6.7a | 0 | 1 | 0 | 0 | 0 |
| b | 0 | 0 | 0 | 0 | 0 |

G = cross-hatch test; T = T-Bend test; * = Duplicate determinations

TABLE 5

| Ex. No. | Adhesion after Salt Spray Exposure of: 0 G | 2,000 Hours T | 2,000 Hours G | Corrosion Around Scribe in mm After Exposure to Salt Spray for: 1000 Hours | 2000 Hours |
|---|---|---|---|---|---|
| 6a | 0 | 1 | 0 | 0 | 0 |
| b | 0 | 1-2 | 0 | 0 | 0.2 |
| 7.1a | 0 | 2 | 0 | 0 | 1 |
| b | 0 | 1 | 0 | 0 | 0 |
| 7.2a | 0 | 1 | 0 | 0 | 0 |

TABLE 5-continued

| Ex. No. | Adhesion after Salt Spray Exposure of: 0 G | 2,000 Hours T | 2,000 Hours G | Corrosion Around Scribe in mm After Exposure to Salt Spray for: 1000 Hours | 2000 Hours |
|---|---|---|---|---|---|
| b | 0 | 0 | 0 | 0 | 0.6 |
| 7.3a | 0 | 0 | 0 | 0 | 1 |
| b | 0 | 0 | 0 | 0 | 0 |
| 7.4a | 0 | 0 | 0 | 0 | 0.9 |
| b | 0 | 1 | 0 | 1 | 0.8 |
| 7.5a | 0 | 0 | 0 | 0 | 0 |
| b | 0 | 2 | 0 | 0 | 0 |
| 7.6a | 0 | 1 | 0 | 0 | 0.7 |
| b | 0 | 0 | 0 | 0 | 0.2 |
| 7.7a | 0 | 0 | 0 | 0 | 0.1 |
| b | 0 | 0 | 0 | 0 | 0 |
| 7a | 0 | 0 | 0 | 0 | 0.2 |
| b | 0 | 0 | 0 | 0 | 0.1 |
| 8.1a | 0 | 0 | 0 | 0 | 1.6 |
| b | 0 | 0 | 0 | 0 | 0.2 |
| 8.2a | 0 | 0 | 0 | 1.0 | 0.9 |
| b | 0 | 0 | 0 | 0 | 1.1 |
| 8.3a | 0 | 0 | 0 | 0 | 1.0 |
| b | 0 | 0 | 0 | 0 | 0 |
| 8.4a | 0 | 0 | 0 | 0 | 0.4 |
| b | 0 | 0 | 0 | 0.2 | 0 |
| 8.5a | 0 | 0 | 0 | 0.8 | 1.5 |
| b | 0 | 0 | 0 | 0 | 0.8 |
| 8.6a | 0 | 0 | 0 | 0 | 0 |
| b | 0 | 0 | 0 | 0 | 0.2 |
| 8.7a | 0 | 0 | 0 | 0 | 0.3 |
| b | 0 | 0 | 0 | 0 | 1.7 |

G = cross-hatch test; T = T-Bend test; * = Duplicate determinations

EXAMPLES 8 AND 9.1–9.7

These examples were performed in the same manner as Examples 3 and 4.1–4.7 respectively, except that Aerosil TM 200, commercially available from Degussa, was employed as the silicon dioxide instead of Syton TM X 30. Aerosil TM 200 has the following characteristic data: Average particle size: 12 nm; BET surface area: 200 $m^2/g$; pH value of a 4% aqueous dispersion: 3.6 to 4.3. The adhesion and corrosion data found in these experiments are shown in Table 6.

TABLE 6

| Ex. No. | Adhesion after Salt Spray Exposure of: 0 G | 2,000 Hours T | 2,000 Hours G | Corrosion Around Scribe in mm After Exposure to Salt Spray for: 1000 Hours | 2000 Hours |
|---|---|---|---|---|---|
| 8a | 0 | 0 | 0 | 0 | 0 |
| b | 0 | 1 | 0 | 0 | 0.1 |
| 9.1a | 0 | 0 | 0 | 0 | 0.8 |
| b | 0 | 0 | 0 | 0.2 | 0 |
| 9.2a | 0 | 1 | 0 | 0 | 0 |
| b | 0 | 0 | 0 | 0 | 0.1 |
| 9.3a | 0 | 0 | 0 | 0 | 0.1 |
| b | 0 | 0 | 0 | 0.1 | 0 |
| 9.4a | 0 | 2 | 0 | 0 | 0 |
| b | 0 | 0 | 0 | 0 | 0 |
| 9.5a | 0 | 1 | 0 | 0 | 0.2 |
| b | 0 | 0 | 0 | 0 | 0.9 |
| 9.6a | 0 | 1 | 0 | 0 | 0.2 |
| b | 0 | 0 | 0 | 0 | 0 |
| 9.7a | 0 | 0 | 0 | 0.2 | 0.6 |
| b | 0 | 1 | 0 | 0 | 0 |

The tables clearly show the positive effect of the pre-treatment carried out by the process according to the invention. The adhesion of the organic coating has been improved over that of untreated sheets as well as over that treated by the standard procedure. The corrosion resistance data are distinctly closer to those obtained by the standard procedure than to the values of the untreated sheets.

What is claimed is:

1. A process for treating a degreased, etched, and pickled metallic surface to improve the adhesion and corrosion protection of organic surface coatings applied to the metallic surface after treatment, comprising the steps of:

(a) contacting the degreased, etched, and pickled surface with a treating liquid that is an aqueous solution, emulsion, or dispersion of aluminum-zirconium complexes which are obtainable as the product of reaction of a chelated aluminum component, an organo-functional ligand component, and a zirconium oxyhalide component, the organo-functional ligand being chemically bonded in the product of reaction to the chelated aluminum unit and the zirconium unit;

(b) rinsing the surface contacted in step (a) with water; and (c) contacting the rinsed surface from step (b) with an aqueous solution, emulsion, or dispersion of one or more inorganic and/or organic film-forming materials, the concentration of all film-forming materials and other solids in said aqueous solution, emulsion, or dispersion being not more than about 2 g/L.

2. A process according to claim 1, wherein the metallic surface treated is aluminum, aluminum alloy, zinc, cadmium, magnesium, steel, galvanized steel, or zinc alloy plated steel.

3. A process according to claim 2, wherein:

(1) the chelated aluminum compound is represented by the general formula (I)

$$Al_2(OR^1O)_aA_bB_c \quad (I)$$

wherein each of A and B independently represents a hydroxyl, fluoro, chloro, bromo, or iodo group; each of a, b, and c denotes a number and $2a+b+c=6$; and $(OR^1O)$ represents:

(A) a moiety derived from a $\alpha,\beta$- or $\alpha,\gamma$- diol having from 2 to 6 carbon atoms by removing the hydrogen atoms from both hydroxyl groups in the diol, with $R^1$ representing a moiety with a formula derived from the formula of an alkane, alkene, or alkyne by removing one hydrogen atom from each of two distinct carbon atoms therein; or (B) a moiety having a chemical formula derived by removing a hydrogen atom from each of the carboxyl and hydroxy groups of an $\alpha$-hydroxycarboxylic acid having a total of 2 to 6 carbon atoms;

(2) the organo-functional ligand component is selected from molecules of alkyl-, alkenyl-, alkynyl-, or aralkyl-carboxylic acids, having from 2 to 36 carbon atoms; amino-functional carboxylic acids having from 2 to 18 carbon atoms; dibasic carboxylic acids having from 2 to 18 carbon atoms; anhydrides of a dibasic carboxylic acid having from 2 to 18 carbon atoms; mercapto-functional carboxylic acids having from 2 to 18 carbon atoms; and epoxy-functional carboxylic acids having from 2 to 18 carbon atoms;

(3) the zirconium oxyhalide component has atomic proportions corresponding to the formula $Zr(OH)_dG_e$, wherein G represents the sum of fluorine, chlorine, bromine, and iodine, each of d and e is a number between 0.05 and 3.95, and d+e=4; and (4) the molar ratio of the chelated aluminum compound to the zirconium oxyhalide is from 1.5 to 10, and the molar ratio of the organo-functional ligand to the total metal content is from 0.05 to 3.

4. A process according to claim 3, wherein the moiety in part (1)(A) is derived from a diol having 2 to 3 carbon atoms, $R^1$ is derived from an alkane, and the moiety in part (1)(B) is derived from an acid having a total of 2 or 3 carbon atoms.

5. A process according to claim 3, wherein the concentration of the aluminum-zirconium complexes in the treating liquid used in step (a) is from 0.05 to g/l.

6. A process according to claim 1, wherein the concentration of the aluminum-zirconium complexes in the treating liquid used in step (a) is from 0.05 to g/l.

7. A process according to claim 5, wherein the period of contact of the aluminum-zirconium complexes with the surfaces is from 1 second to 5 minutes at a liquid temperature of from 10° C. to 60° C.

8. A process according to claim 1, wherein the period of contact of the aluminum-zirconium complexes with the surfaces is from 1 second to 5 minutes at a liquid temperature of from 10° C. to 60° C.

9. A process according to claim 7, wherein free or complex fluorides at a concentration of from 0.01 to 1 g/l are present in the treatment liquid used in step (a).

10. A process according to claim 1, wherein free or complex fluorides at a concentration of from 0.01 to 1 g/l are present in the treating liquid used in step (a).

11. A process according to claim 9, wherein polyacrylic acid, polyacrylates, polyesters, polyurethanes, or polyepoxy compounds at a concentration in water of from 0.01 to 2 g/l, are used as the film formers in step (c).

12. A process according to claim 1, wherein polyacrylic acid, polyacrylates, polyesters, polyurethanes, or polyepoxy compounds at a concentration in water of from 0.01 to 2 g/l, are used as the film formers in step (c).

13. A process according to claim 9, wherein aqueous solutions, emulsions, or dispersions of metal oxide, at a concentration of from 0.05 to 5 g/l, are used as the film formers in step (c).

14. A process according to claim 1 wherein aqueous solutions, emulsions, or dispersions of metal oxide, at a concentration of from 0.05 to 5 g/l, are used as the film formers in step (c).

15. A process according to claim 14, wherein the metal oxides are selected from silicon oxide, titanium dioxide and/or aluminum oxide.

16. A process according to claim 13, wherein the metal oxides are selected from silicon oxide, titanium dioxide and/or aluminum oxide.

17. A process according to claim 16, wherein the period of contact in step (c) is from 1 second to 5 minutes at a liquid temperature of from 10° C. to 60° C.

18. A process according to claim 13, wherein the period of contact in step (c) is from 1 second to 5 minutes at a liquid temperature of from 10° C. to 60° C.

19. A process according to claim 5, wherein the period of contact in step (c) is from 1 second to 5 minutes at a liquid temperature of from 10° C. to 60° C.

20. A process according to claim 1, wherein the period of contact in step (c) is from 1 second to 5 minutes at a liquid temperature of from 10° C. to 60° C.

* * * * *

UNITED STATES PATENT AND TRADEMARK OFFICE

CERTIFICATE OF CORRECTION

PATENT NO. : 5,026,440

DATED : June 25, 1991

INVENTOR(S) : Cornelia Finnenthal et al

It is certified that error appears in the above-identified patent and that said Letters Patent is hereby corrected as shown below:

At Column 13, in Claim 5, line 15, "(a) is from 0.05 to g/l." should read --(a) is from 0.05 to 50 g/l.--

At Column 13, in Claim 6, line 18, "(a) is from 0.05 to g/l." should read --(a) is from 0.05 to 50 g/l.--

Signed and Sealed this

Twenty-ninth Day of December, 1992

*Attest:*

DOUGLAS B. COMER

*Attesting Officer*

*Acting Commissioner of Patents and Trademarks*